US011215341B2

(12) United States Patent
Sieczkowski

(10) Patent No.: US 11,215,341 B2
(45) Date of Patent: Jan. 4, 2022

(54) LIGHT FIXTURE WITH DRAINAGE SYSTEM

(71) Applicant: ABL IP Holding LLC, Atlanta, GA (US)

(72) Inventor: Philip Sieczkowski, Lawrenceville, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/775,359

(22) Filed: Jan. 29, 2020

(65) Prior Publication Data

US 2020/0240616 A1 Jul. 30, 2020

Related U.S. Application Data

(60) Provisional application No. 62/798,215, filed on Jan. 29, 2019.

(51) Int. Cl.
*F21V 15/01* (2006.01)
*F21W 131/107* (2006.01)

(52) U.S. Cl.
CPC ..... *F21V 15/01* (2013.01); *F21W 2131/107* (2013.01)

(58) Field of Classification Search
None
See application file for complete search history.

(56) References Cited

U.S. PATENT DOCUMENTS

| | | | | |
|---|---|---|---|---|
| 4,658,339 | A * | 4/1987 | Tammerijn | F21S 8/04 362/294 |
| 7,246,926 | B2 * | 7/2007 | Harwood | F21S 2/00 362/234 |
| 7,686,469 | B2 | 3/2010 | Ruud et al. | |
| 8,833,993 | B1 * | 9/2014 | Lyons | B60Q 1/263 362/549 |
| 9,453,639 | B2 * | 9/2016 | Mandy | F21S 8/026 |
| 9,746,170 | B1 * | 8/2017 | Armer | F21V 29/503 |
| D797,339 | S | 9/2017 | Wang | |
| 9,803,844 | B2 * | 10/2017 | Chad | F21V 31/005 |
| 10,072,806 | B1 * | 9/2018 | Yarnell | F21V 1/143 |
| 10,480,773 | B2 * | 11/2019 | Corkill | F21V 15/01 |
| 2002/0089419 | A1 * | 7/2002 | Martineau | F21V 5/04 340/463 |
| 2008/0157112 | A1 * | 7/2008 | He | F21K 9/233 257/98 |
| 2008/0285289 | A1 * | 11/2008 | Chen | F21V 15/01 362/373 |

(Continued)

*Primary Examiner* — Elmito Breval
(74) *Attorney, Agent, or Firm* — Kilpatrick Townsend & Stockton LLP

(57) ABSTRACT

A light fixture includes a housing, a bezel, and an optic. The bezel is coupled to the housing such that the optic is positioned between at least a portion of the bezel and the housing. The bezel includes a drainage system, and the drainage system includes at least one drainage opening in the bezel proximate to a front side of the light fixture and at least one weep opening between the bezel and the optic. The drainage system also includes a drainage gap between the housing and the bezel proximate to a back side of the light fixture that is opposite the front side and a drainage channel in fluid communication with the at least one drainage opening, the at least one weep opening, and the drainage gap.

20 Claims, 19 Drawing Sheets

(56) References Cited

U.S. PATENT DOCUMENTS

| | | | | |
|---|---|---|---|---|
| 2013/0088871 | A1* | 4/2013 | Yun | F21V 29/51 362/249.01 |
| 2016/0356483 | A1* | 12/2016 | Gebhard | F21V 29/74 |
| 2016/0377247 | A1 | 12/2016 | Chang | |
| 2017/0307204 | A1* | 10/2017 | Cattoni | F21V 25/12 |
| 2018/0010784 | A1* | 1/2018 | Kim | H01L 33/48 |
| 2018/0272926 | A1* | 9/2018 | Lyons | B60Q 1/2696 |

* cited by examiner

LIGHT FIXTURE WITH DRAINAGE SYSTEM

REFERENCE TO RELATED APPLICATION

This application claims the benefit of U.S. Provisional Patent Application No. 62/798,215, filed on Jan. 29, 2019 and entitled LIGHT FIXTURE WITH DRAINAGE SYSTEM, the content of which is hereby incorporated by reference in its entirety.

FIELD OF THE INVENTION

This application relates to light fixtures, and, more particularly, to light fixtures with drainage systems.

BACKGROUND

Light fixtures are commonly used in both indoor and outdoor applications to provide various types of lighting. For example, flood lights may be installed to "wall wash" a building, highlight landscape or other architectural features, or project general area lighting. Such light fixtures may be installed as an up-light installation (e.g., when the light fixture is ground-mounted) or a down-light installation (e.g., when the light fixture is mounted on a pole, wall, or other structure) depending on application requirements. When light fixtures are provided outdoors, up-light installations will invariably see rain or snow on the lens of the light fixture, which may collect and undesirably affect light output. In such installations, depending on the projection angle of the light fixture, significant accumulation may remain or freeze for long periods and seriously degrade performance of the light fixture. Outdoor down-light installations may see similar accumulation of water or snow on the rear of the light fixture, which increases the likelihood that moisture enters the housing through seams of the light fixture.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to various embodiments, a bezel for a light fixture includes an inner side wall, an outer side wall, and a bezel face. The inner side wall defines a bezel opening that extends through the bezel from a front end of the bezel to a rear end of the bezel. The bezel face connects the inner side wall and the outer side wall at the front end. The inner side wall, the outer side wall, and the bezel face define a drainage channel, and a portion of an edge of the inner side wall opposite from the bezel face includes a drainage notch that is in fluid communication with the drainage channel.

According to some embodiments, a light fixture includes a housing and a bezel. The housing includes a perimeter edge, and the bezel is coupled to the housing. The bezel includes an inner side wall defining a bezel opening that extends through the bezel from a front end of the bezel to a rear end of the bezel. The bezel also includes an outer side wall and a bezel face connecting the inner side wall and the outer side wall at the front end. The inner side wall, the outer side wall, and the bezel face define a drainage channel, and the bezel face includes a drainage opening between the inner side wall and the outer side wall and that is in fluid communication with the drainage channel. The bezel is coupled to the housing such that a drainage gap is defined between an inner surface of the outer side wall and the perimeter edge of the housing that is in fluid communication with the drainage opening.

According to various embodiments, a light fixture includes a housing, an optic, and a bezel. The bezel is coupled to the housing such that the optic is positioned between at least a portion of the bezel and the housing. The bezel includes a drainage system, and the drainage system includes at least one drainage opening in the bezel proximate to a front side of the light fixture, at least one weep opening between the bezel and the optic, a drainage gap between the housing and the bezel proximate to a back side of the light fixture that is opposite the front side, and a drainage channel in fluid communication with the at least one drainage opening, the at least one weep opening, and the drainage gap.

Various implementations described herein can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described. Directional references such as "up," "down," "top," "bottom," "left," "right," "front," and "back," among others are intended to refer to the orientation as illustrated and described in the figure (or figures) to which the components and directions are referencing.

Described herein are drainage systems for a light fixture and light fixtures that incorporate such drainage systems. The light fixtures described herein are provided with light emitting diodes (LEDs). While LEDs are described, it will be recognized that light fixtures may include other kinds of light sources such as fluorescent, incandescent, halogen, etc.

Light Fixture Assembly

Figure 1:
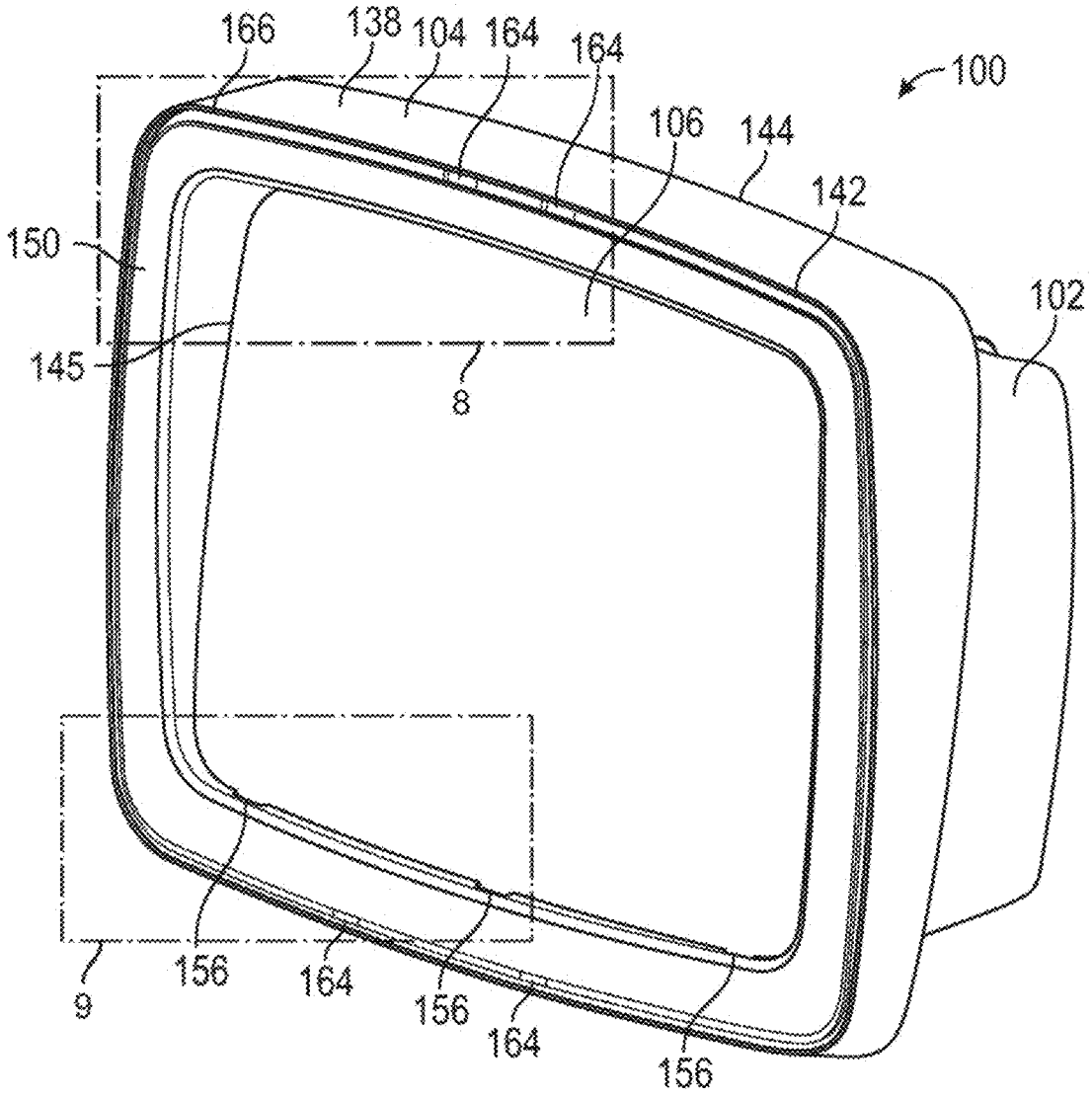
FIG. 1 is a perspective view of a light fixture with a drainage system according to embodiments of the disclosure.
Figure 2:
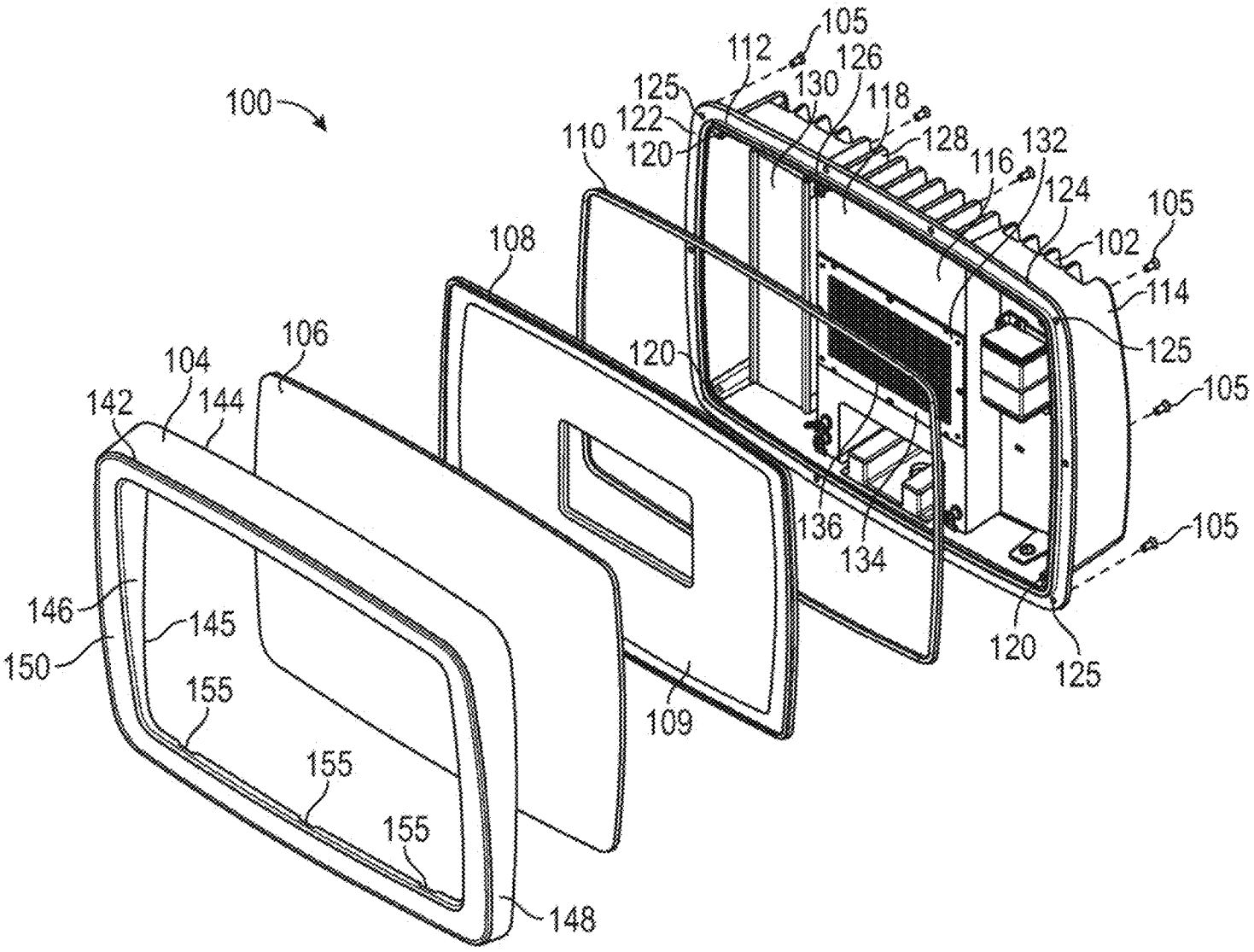
FIG. 2 is an exploded assembly view of the light fixture of FIG. 1.

FIGS. 1-15 illustrate an embodiment of a light fixture 100 that includes a housing 102 and a bezel 104. As best illustrated in FIG. 2, the light fixture 100 also includes an optic 106, a reflector 108, and optionally a gasket 110. In some cases, the light fixture 100 is a flood light, although it may be various other types of light fixtures in other embodiments.

Figure 3:
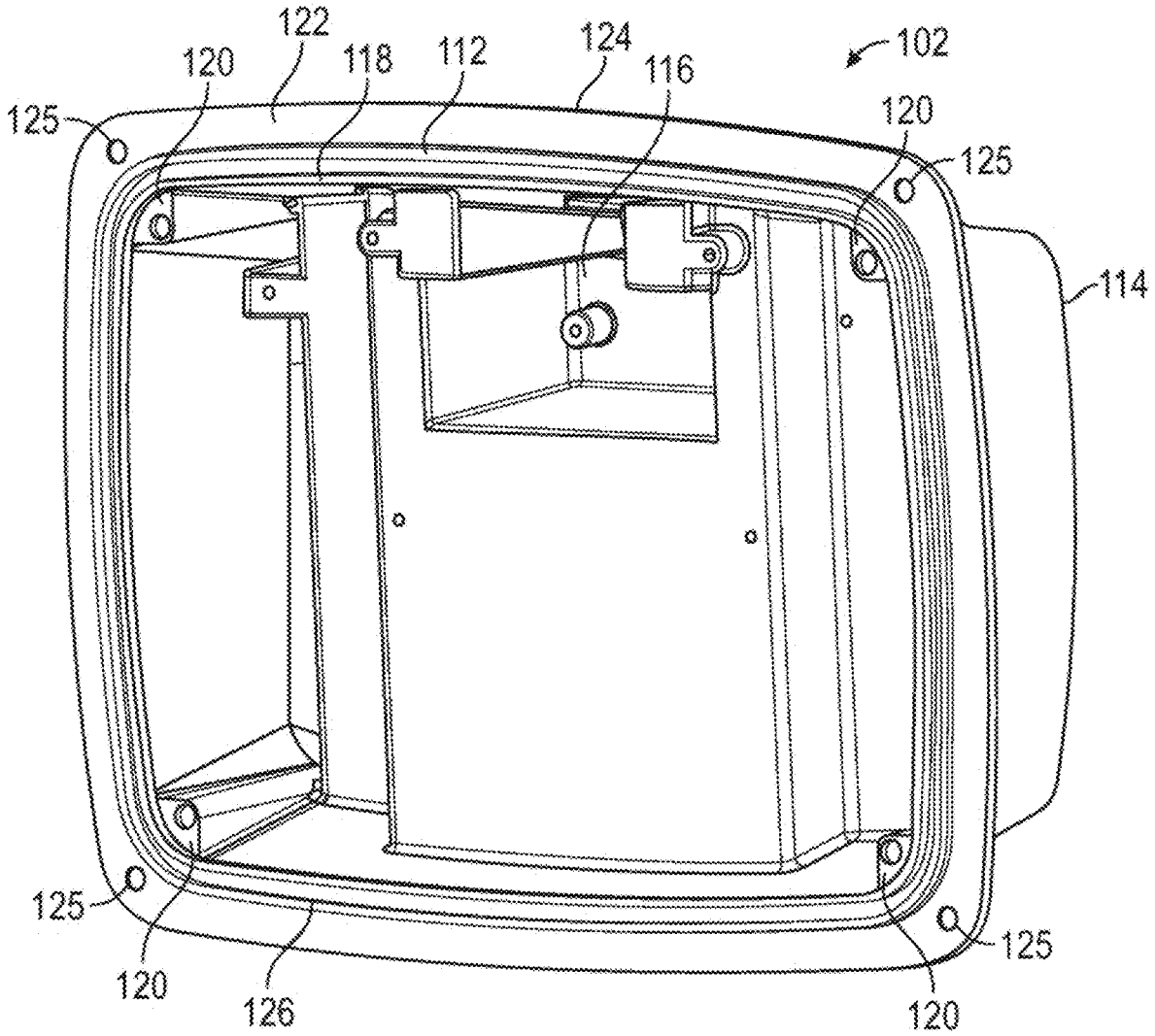
FIG. 3 is a perspective view of a housing of the light fixture of FIG. 1.
Figure 4:
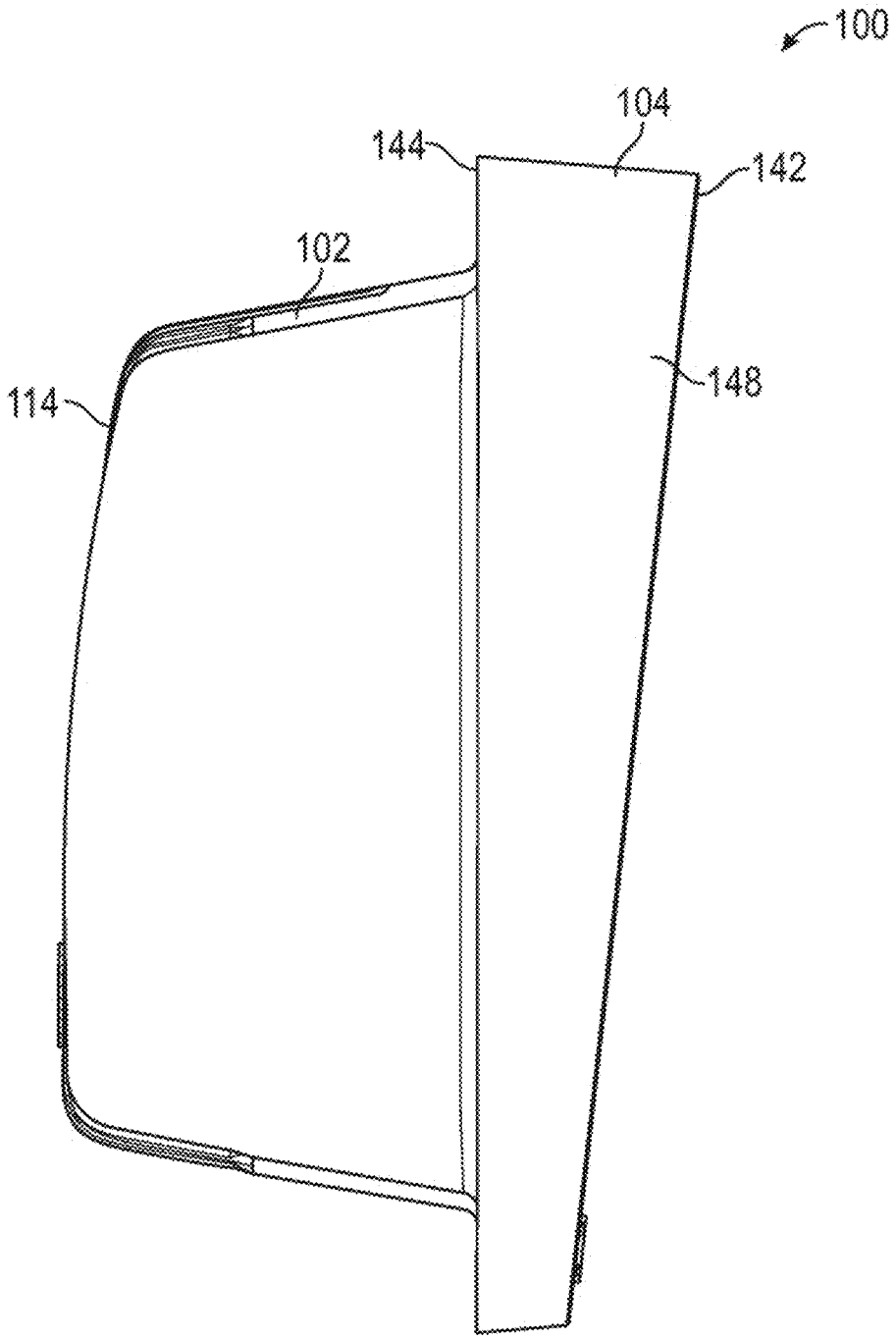
FIG. 4 is a side view of the light fixture of FIG. 1.
Figure 5:
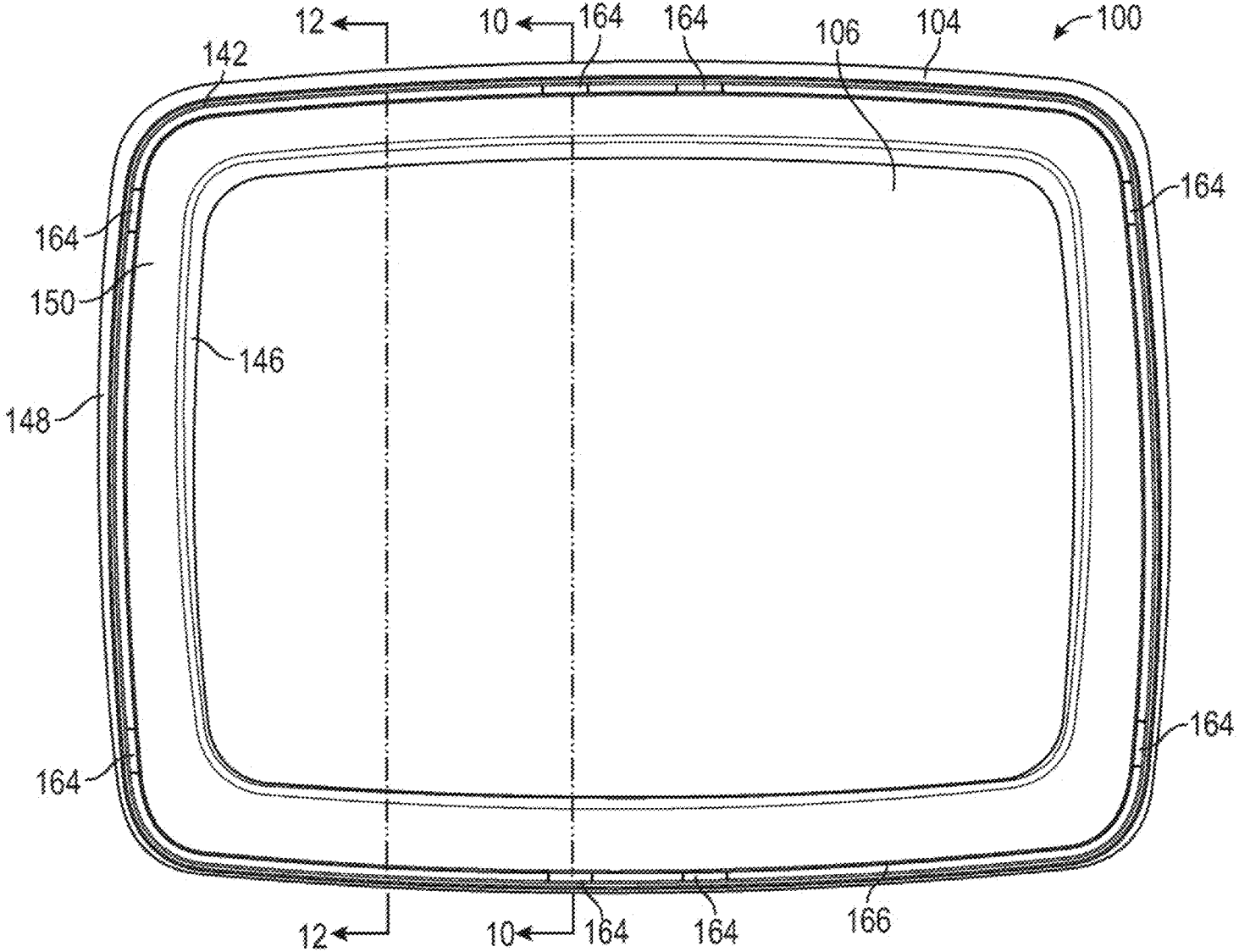
FIG. 5 is a front view of the light fixture of FIG. 1.
Figure 6:
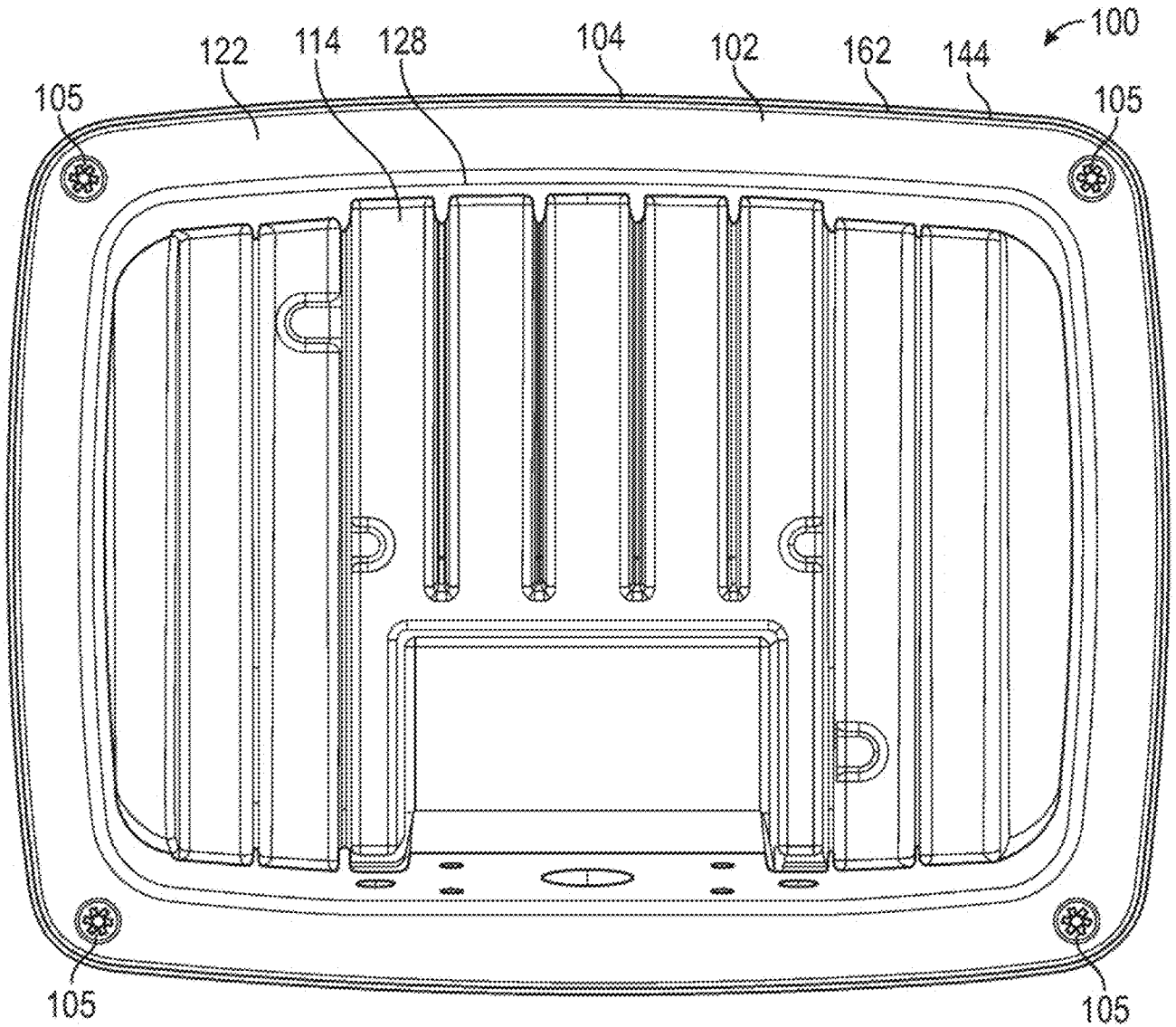
FIG. 6 is a rear view of the light fixture of FIG. 1.
Figure 7:
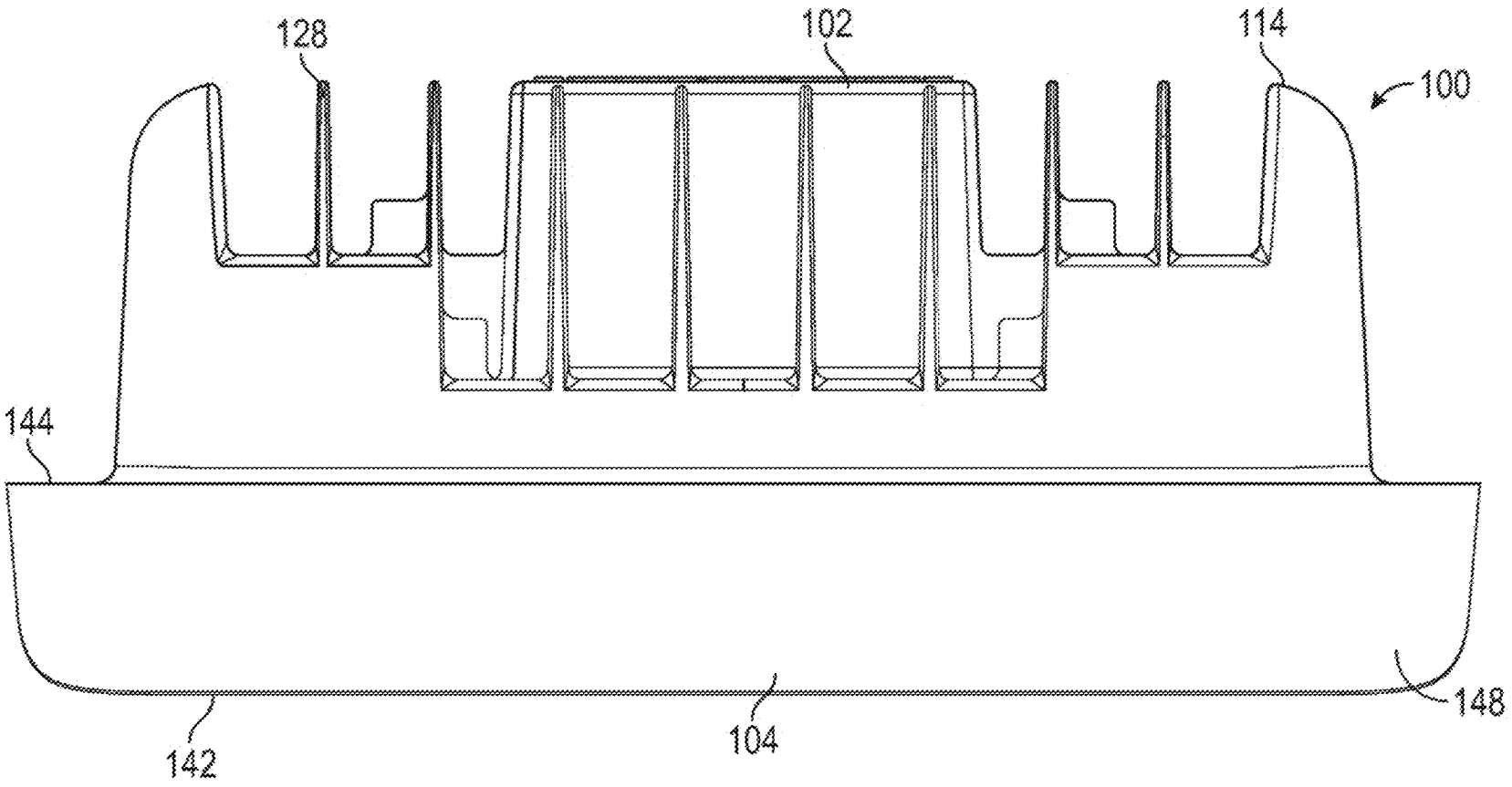
FIG. 7 is a top view of the light fixture of FIG. 1.
Figure 8:
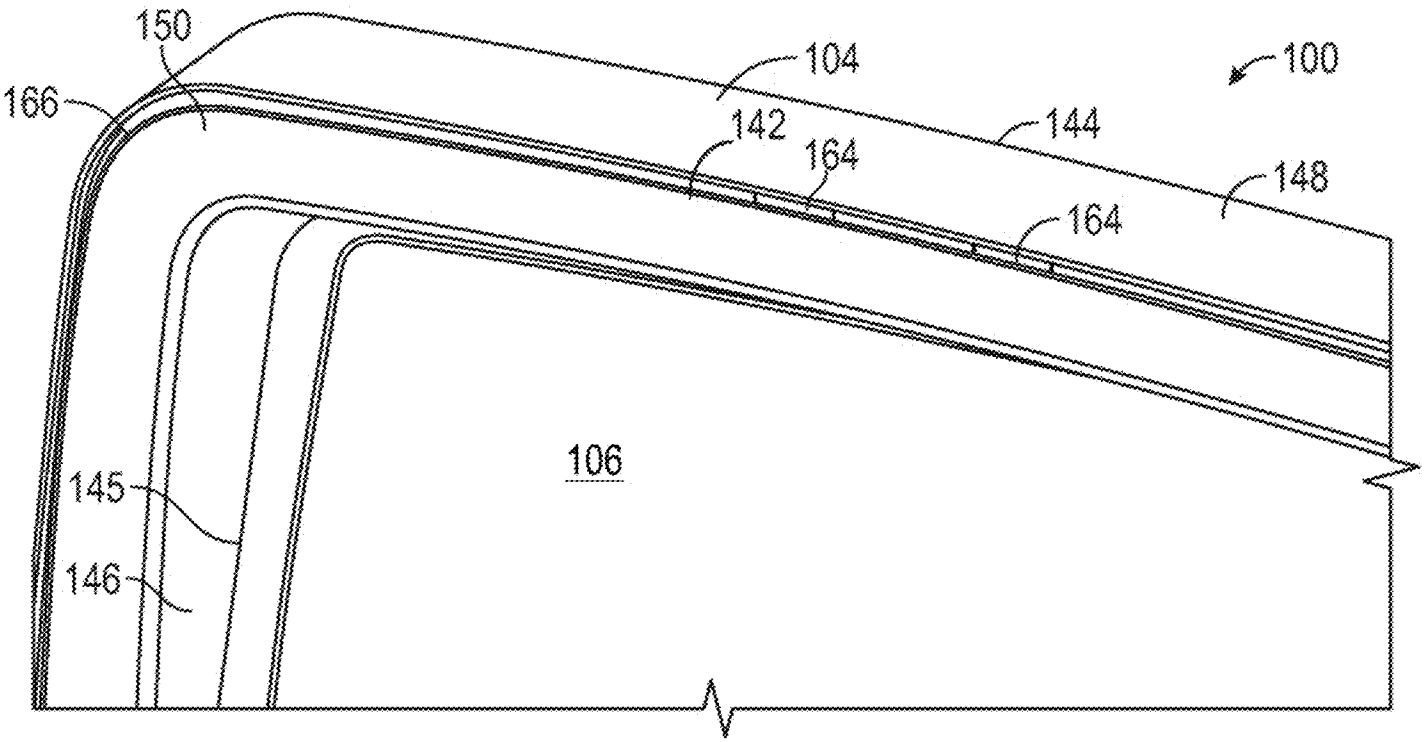
FIG. 8 is an enlarged view of the light fixture of FIG. 1 taken from detail rectangle 8 in FIG. 1.

The housing 102 includes a front side 112 and a back side 114. The housing 102 also defines a housing chamber 116 that has an opening 118 in the front side 112. Various electronic components of the light fixture 100 such as a driver 130, light source 132, etc. may be provided in the housing chamber 116. In some examples, and as best illustrated in FIGS. 2 and 3, mounting bosses 120 (or other suitable components) may optionally be provided within the housing chamber 116 to retain the reflector 108 within the housing 102. In the example of FIGS. 1-15, the mounting bosses 120 include set screw apertures that receive set screws to secure the reflector 108 relative to the housing 102, although various other suitable coupling mechanisms or components may be utilized.

In various examples, the housing 102 includes a flange 122 that includes a perimeter edge 124. In some cases, the perimeter edge 124 may be the outermost edge of the housing 102, although it need not be in other examples. The flange 122 also includes coupling apertures 125 that receive screws or bolts 105 to secure the bezel 104 relative to the housing 102. While coupling apertures 125 are illustrated, various other suitable mechanisms or components for coupling the bezel 104 relative to the housing 102 may be utilized.

In some examples, the front side 112 includes a gasket channel 126 for the gasket 110, although in other examples the gasket channel 126 may be omitted. Optionally, heat sink elements 128 (e.g., fins and/or other suitable elements) may be provided on the housing 102, although they may be omitted in other examples. The shape, profile, and/or configuration of the housing 102 and/or components of the housing 102 should not be considered limiting on the current disclosure, as in various other examples, the housing may have various other shapes, profiles, or configurations as desired. For example, in other cases, the housing 102 may be square, rectangular, circular, cylindrical, or have various other geometric shapes or profiles as desired.

As mentioned above, various electronics of the light fixture 100 may be positioned within the housing chamber 116. In the example of FIGS. 1-15, a driver 130 and the light source 132 are positioned within the housing chamber 116. In some examples, the light source 132 may include at least one printed circuit board (PCB) 134 populated with one or more LEDs 136 that are configured to emit a light source emission. Each PCB can have wiring for connecting to a power supply, which can be shared between PCBs or each PCB could have its own power supply. The LEDs 136 may be single-die or multi-die LEDs, DC or AC, can be organic LEDS, and/or may be various other suitable LEDs. White, color, or multicolor LEDs may be used. Moreover, the LEDs mounted on a PCB need not all be the same color; rather, mixtures of LEDs may be used. Furthermore, in some embodiments no PCB is needed; rather, the LEDs are chip-on-board LEDs. In other examples, the light source 132 may be various other suitable devices for emitting a light source emission.

The optic 106 (such as a lens, diffuser, or other suitable optic as desired) is positioned on or over the opening 118. The optic 106 can be made of any non-metallic material that permits light to exit through the optic 106, including, but not limited to, glass, polymeric materials, silicone and various other suitable materials for light distribution. As best illustrated in FIG. 10, when the light fixture 100 is assembled, the gasket 110 may be positioned between the optic 106 and the housing 102 such that a seal is formed. In various aspects, the gasket 110 creates a watertight seal such that the housing chamber 116 is sealed. Various suitable types of materials and/or sealants may be used as the gasket 110. The reflector 108 may be provided between the housing 102 and the optic 106. In the example of FIGS. 1-15, the reflector 108 is positioned at least partially within the housing chamber 116. When so positioned, light from the light source 132 passes through a central opening in the reflector 108, although the shape and configuration of the reflector 108 and light source 132 should not be considered limiting on the current disclosure. The reflector 108 may have various suitable shapes or profiles to control the directionality or appearance of light emitted by the light fixture 100. The reflector 108 includes a reflective surface 109, which can include reflective materials such as, but not limited to, polished metals, reflective coatings, reflective paints, or other reflective compositions, to render the reflective surface 109 reflective or enhance the reflectivity of the surface 109.

Figure 15:
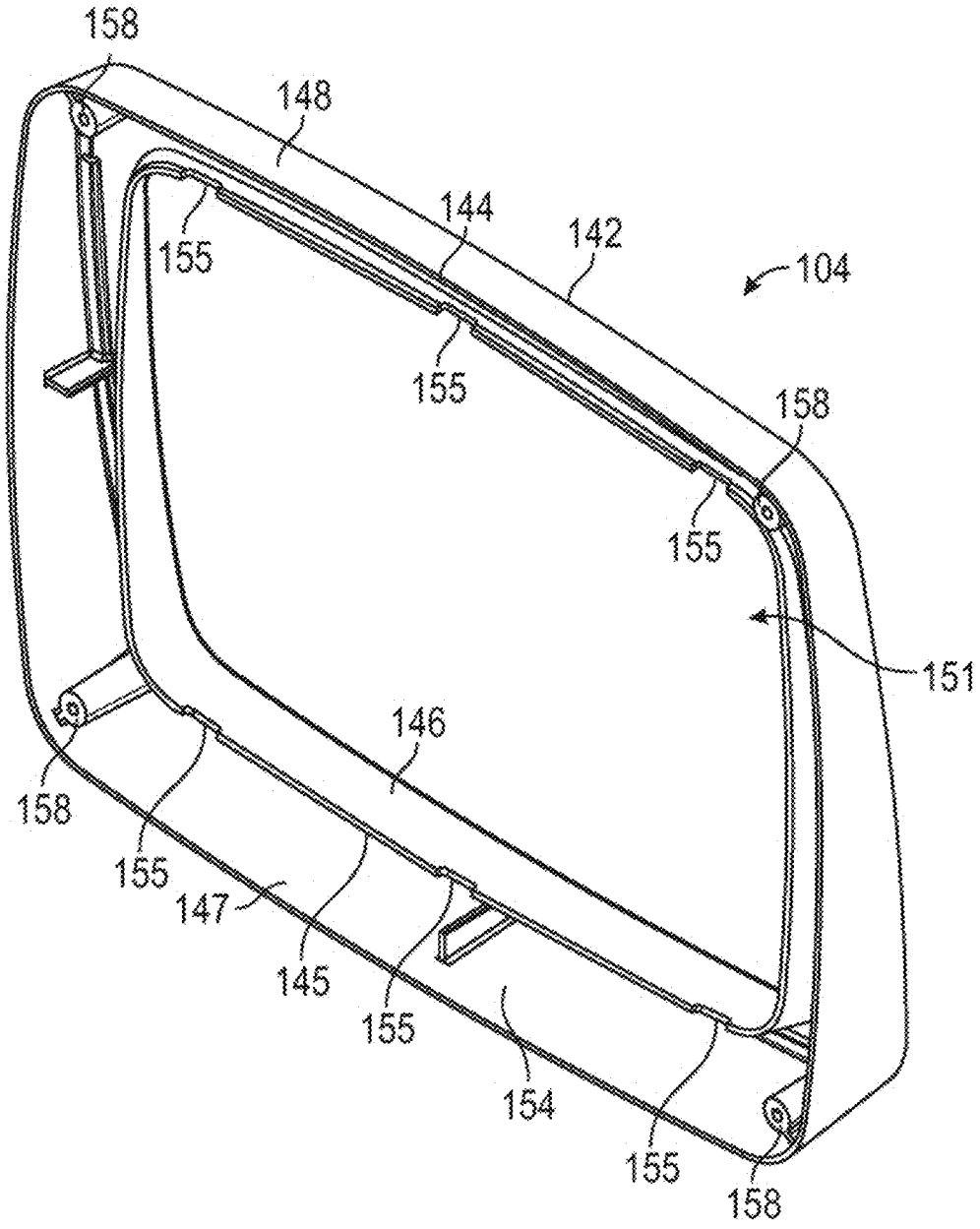
FIG. 15 is a rear perspective view of the bezel of the light fixture of FIG. 1.

The bezel 104 includes a front end 142, a rear end 144, at least one inner side wall 146, and at least one outer side wall 148. As best illustrated in FIG. 15, inner side wall(s) 146 may define a bezel opening 151 that extends through the bezel 104 from the front end 142 to the rear end 144. The inner side wall(s) 146 and outer side wall(s) 148 extend between the front end 142 and the rear end 144. Optionally, and as best illustrated in FIG. 15, the outer side wall(s) 148 may encompass the inner side wall(s) 146. A bezel face 150 connects the inner side wall(s) 146 and outer side wall(s) 148 at the front end 142. In other words, the bezel face 150 may space the outer side walls(s) 148 apart from the inner side wall(s) 146. In some cases, the bezel face 150 (and/or a distance between the outer side wall(s) 148 and the inner side wall(s) 146) may define a width of a drainage channel 154 (discussed below). The bezel may include mounting features 158 (see FIG. 15) that cooperate with the coupling apertures 125 (or other suitable device on the housing 102) such that the bezel 104 can be secured relative to the housing 102. In the present examples, the mounting features 158 are bosses defining screw apertures, although in other examples, various other suitable mounting features may be utilized. In the illustrated embodiment, screws 105 pass through apertures 125 in the housing 102 and engage mounting features 158 to secure the housing 102 and bezel 104 together.

As best illustrated in FIGS. 10-13 and 15, when the bezel 104 is assembled with the housing 102, the outer side wall(s) 148 of the bezel 104 is positioned adjacent to the flange 122 of the housing 102 such that a drainage gap 162 is defined between the inner surface 147 of the outer side wall(s) 148 and the perimeter edge 124 of the flange 122. In various examples, the drainage gap 162 is defined along the entire perimeter edge 124 of the flange 122; however, in other examples, the drainage gap 162 may only be defined along portions of the perimeter edge 124 of the flange 122.

When assembled, the bezel 104 is secured to the housing 102 and the optic 106 and reflector 108 are retained between the bezel 104 and the housing 102. In various aspects, the bezel 104 is secured to the housing 102 such that the bezel 104 applies pressure onto the optic 106 to maintain the seal between the optic 106 and the housing 102. In some examples, a side profile of the bezel 104 is tapered such that the thickness of the outer side wall 148 at a top portion of the bezel 104 is different than its thickness at a bottom portion of the bezel 104. In the illustrated embodiment (see FIG. 4), the outer side wall 148 of the bezel 104 is thicker at the top of the bezel 104. However, the profile or shape of the bezel 104 should not be considered limiting on the current disclosure.

The light fixture 100 may include various mechanisms or devices for supporting the light fixture 100 in a particular location or on a particular device. As some non-limiting examples, various mounting mechanisms that can be used with the light fixture 100 may include, but are not limited to, a mounting bracket or yoke, a slip fitter that slips over the end of a mounting pole, and/or a knuckle. In various cases, the mounting mechanisms may enable the orientation of the light fixture 100 to be adjusted (either pivotably, rotationally, or both).

Drainage System

The bezel 104 defines a drainage system for the light fixture 100. Through the drainage system, water or other fluids falling onto the light fixture 100 may be drained from the light fixture 100 regardless of whether the light fixture 100 is an up-light installation or a down-light installation. In various aspects, the drainage system may drain water in any installation configuration while maintaining the integrity of the sealed housing chamber 116. In various aspects, the light fixture 100 with the drainage system may achieve various environment ratings, including but not limited to an IP66 environmental rating from the International Electrotechnical Commission.

Figure 9:
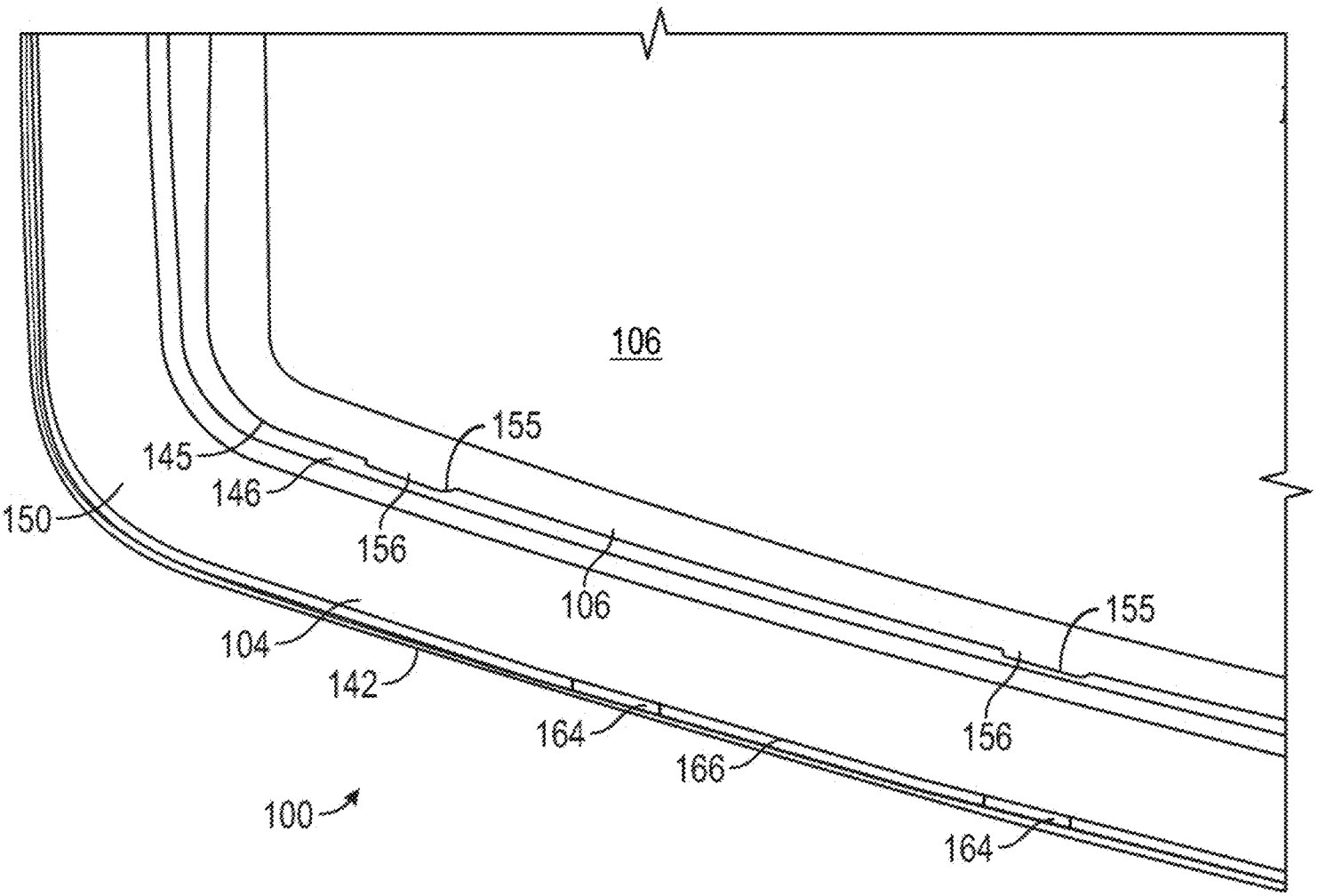
FIG. 9 is an enlarged view of the light fixture of FIG. 1 taken from detail rectangle 9 in FIG. 1.
Figure 10:
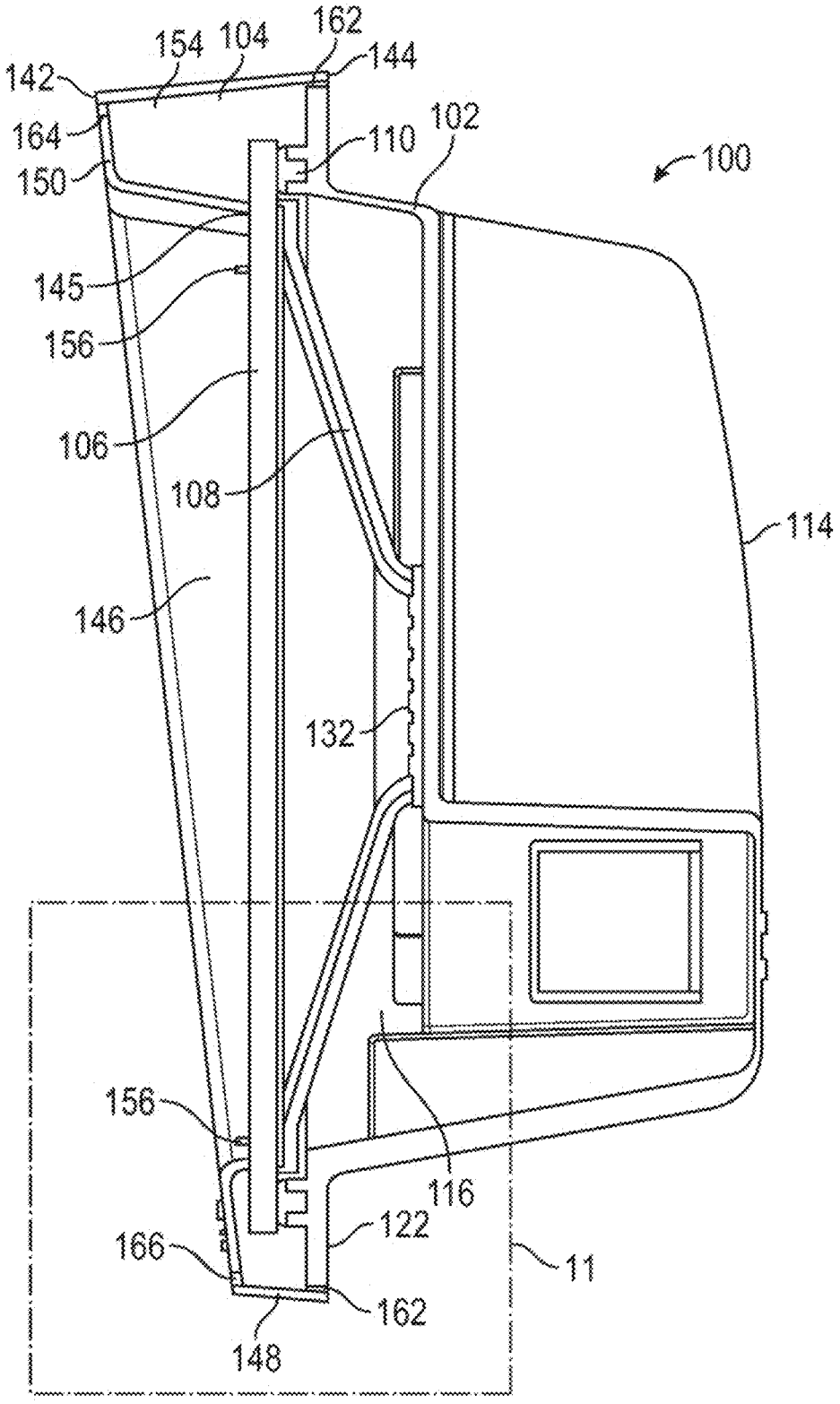
FIG. 10 is a sectional view of the light fixture of FIG. 1 taken along line 10-10 in FIG. 5.
Figure 11:
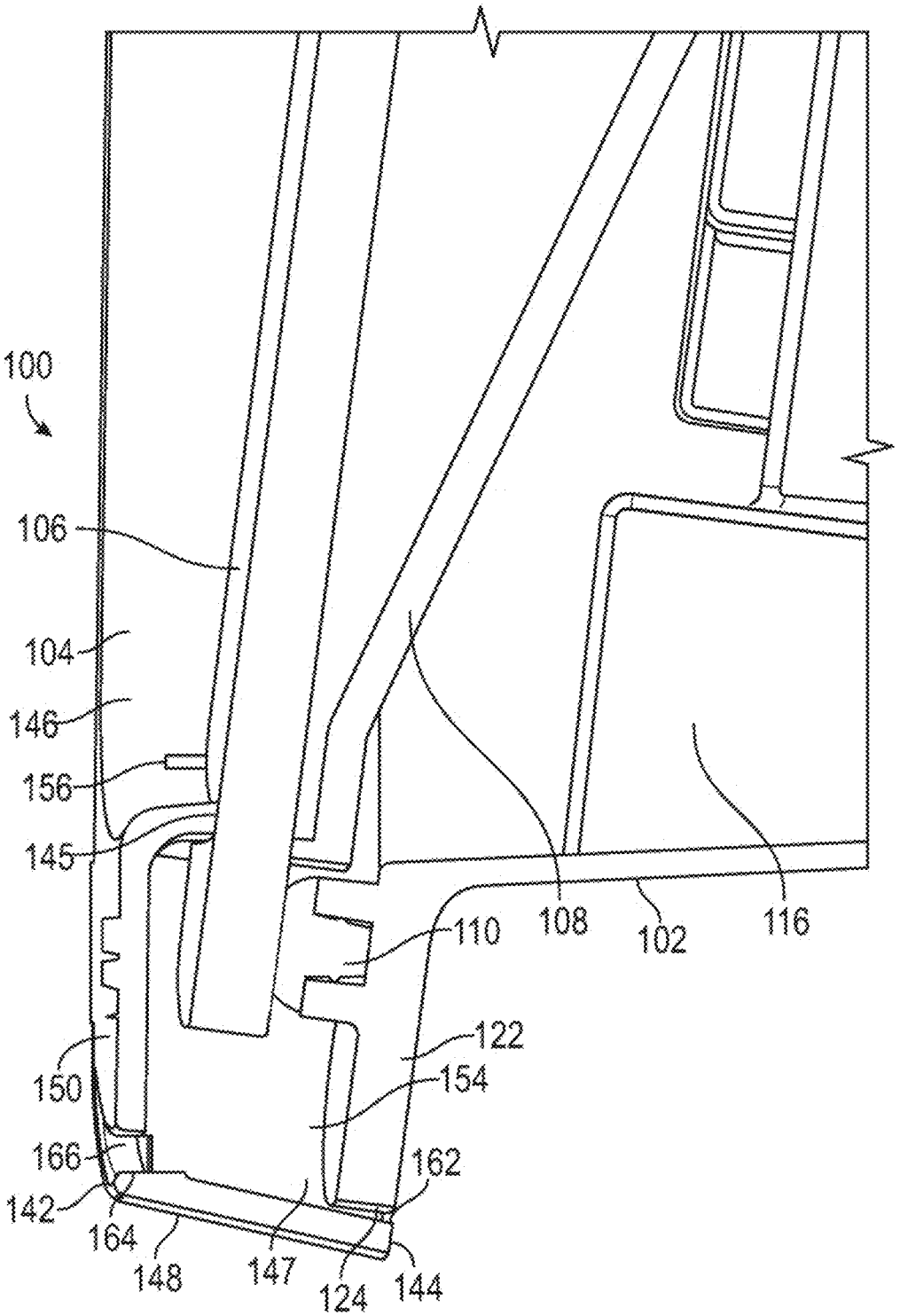
FIG. 11 is an enlarged view of the light fixture of FIG. 1 take from detail rectangle 11 in FIG. 10.
Figure 12:
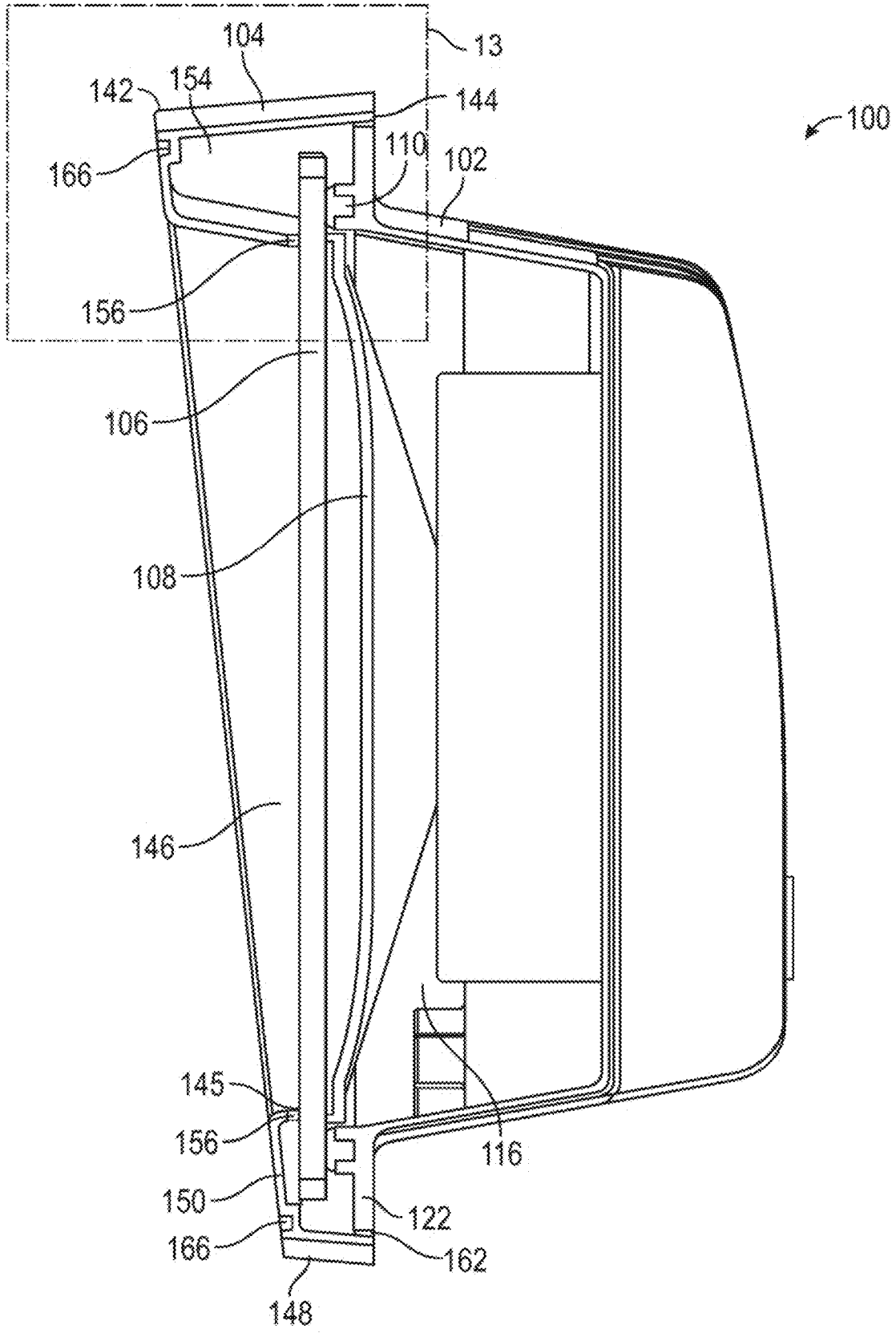
FIG. 12 is a sectional view of the light fixture of FIG. 1 taken along line 12-12 in FIG. 5.
Figure 13:
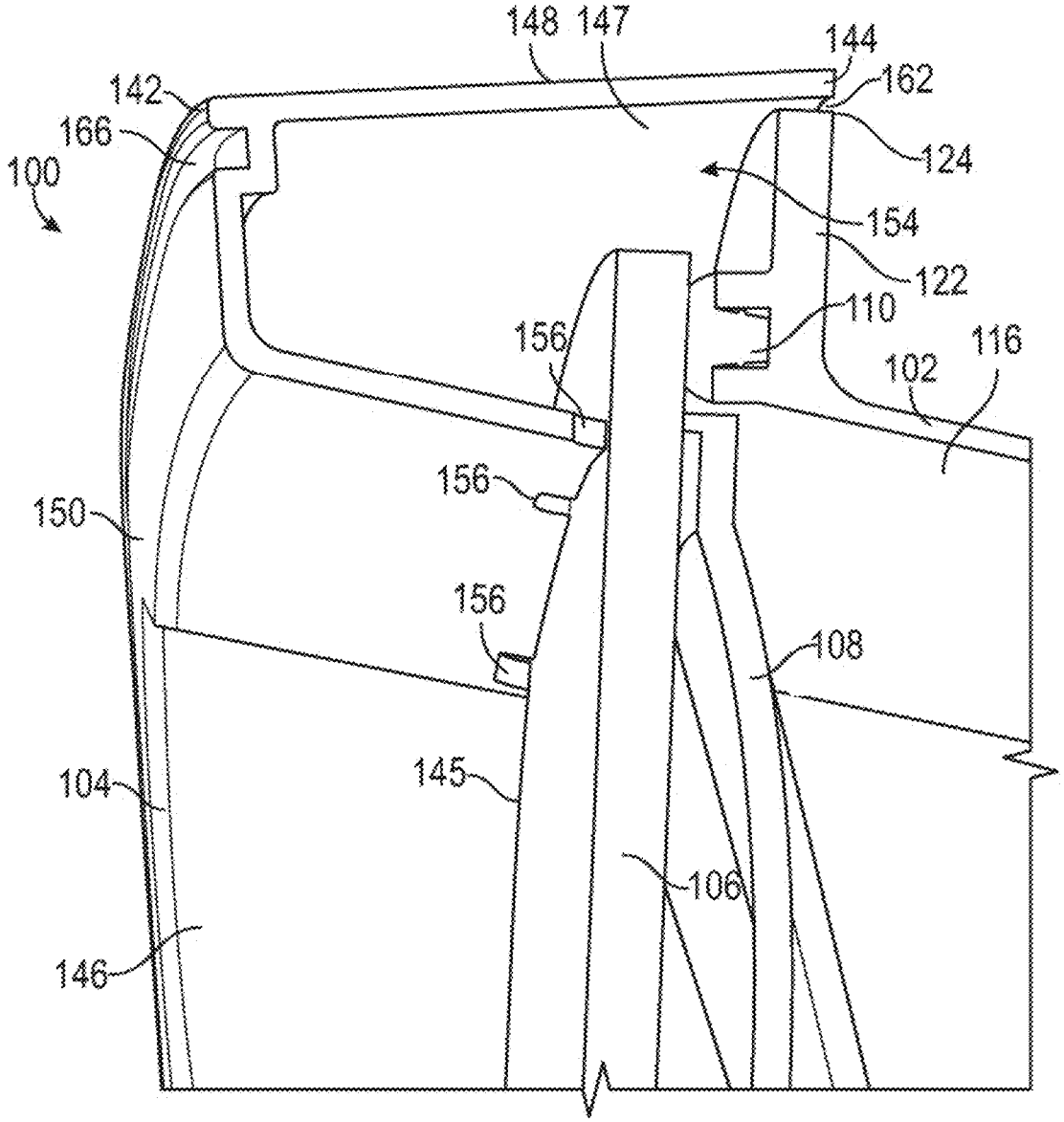
FIG. 13 is an enlarged view of the light fixture of FIG. 1 take from detail rectangle 13 in FIG. 12.
Figure 14:
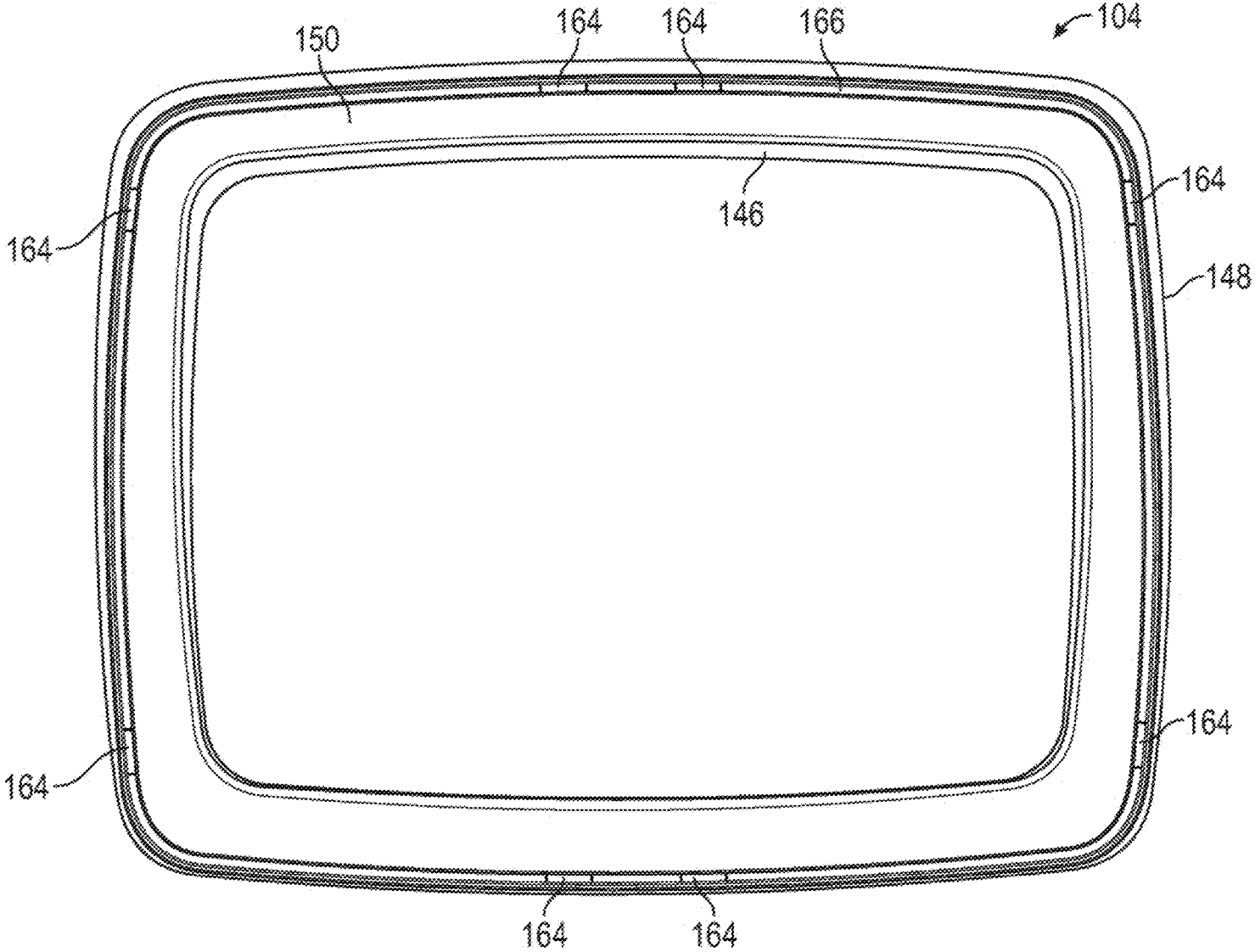
FIG. 14 is a front view of a bezel of the light fixture of FIG. 1.

In various examples, one or more drainage notches 155 are provided along the rear edge 145 of the inner side wall(s) 146 proximate the rear end 144 of the bezel 104 (see FIGS. 2, 9, and 15). As best illustrated in FIGS. 10-13 and 15, the bezel face 150, the inner side wall(s) 146, and the outer side wall(s) 148 define the drainage channel 154 along the back side of the bezel 104. When the light fixture 100 is assembled, the rear edge 145 of the inner side wall(s) 146 of the bezel 104 abuts the optic 106, and the drainage notches 155 define weep openings 156 that are in fluid communication with the drainage channel 154. (See FIGS. 1, 9, 10, 12, 13). The number, shape, and location of the drainage notches 155 and weep openings 156 should not be considered limiting on the current disclosure. The drainage channel 154, in turn, is in fluid communication with the drainage gap 162. Water or other fluids collecting on the optic 106 are able to drain from the light fixture 100 by flowing through the weep openings 156, passing through the drainage channel 154, and exiting the fixture via with the drainage gap 162. Flow of water or other fluids via the drainage system are discussed in greater detail below with reference to FIGS. 16-19. In some cases, the size, shape, and position of the notches 155 are large enough to allow moderate rainfall, condensation, or frost melt to flow from the lens surface while remaining small enough such that they are visually unobtrusive while maintaining pressure against the lens and the gasket beneath.

In some examples, and as best illustrated in FIGS. 1, 8, 9, 11, and 14, one or more drainage openings 164 are also defined in the bezel face 150. In some examples, the drainage openings 164 are defined adjacent to the front end 142 of the bezel 104, although they need not be in other examples. The drainage openings 164 are also in fluid communication with the drainage channel 154. In various examples, the drainage openings 164 are defined in a groove 166 that extends around at least a portion of the perimeter of the bezel face 150 (and/or along at least a portion of the bezel opening 151), although they need not be in other examples. The number, shape, and location of the drainage openings 164 should not be considered limiting on the current disclosure. In some cases, the size, shape, and position of the openings 164 are large enough to allow moderate rainfall, condensation, or frost melt to flow from the lens surface while remaining small enough such that they are visually unobtrusive while maintaining pressure against the lens and the gasket beneath.

FIGS. 16-19 illustrate some examples of flow paths of water (represented by arrows 1601, 1701, 1801, and 1901, respectively) from a light fixture 1600 when the light fixture is in various installation configurations. The light fixture 1600 is substantially similar to the light fixture 100 except that the shape of the housing 102 and the shape of the bezel 104 of the light fixture 1600 is different from the shape of the housing 102 and the shape of the bezel 104 of the light fixture 100. As illustrated in FIGS. 16-19, the light fixture 1600 includes a mounting bracket 1603 as a mounting mechanism that may be used to support the light fixture 1600 in a particular location or on a particular device. The mounting bracket 1603 pivotably supports the light fixture 1600 such that the light fixture 1600 may be adjusted to various orientations or configurations as desired. However, the mounting bracket 1603 should not be considered limiting on the disclosure, and the mounting mechanism may be other suitable devices or mechanisms for supporting the light fixture 1600 as desired.

Because the weep openings 156, drainage openings 164, and drainage gap 162 are in fluid communication with each other (i.e., through the drainage channel 154), the drainage system is able to drain water from the light fixture 100 regardless of the particular configuration of the light fixture 100. It will be appreciated that air or other gaseous substances may also flow through the various gaps and openings to dry any internal surfaces to which water may be held.

Figure 16:
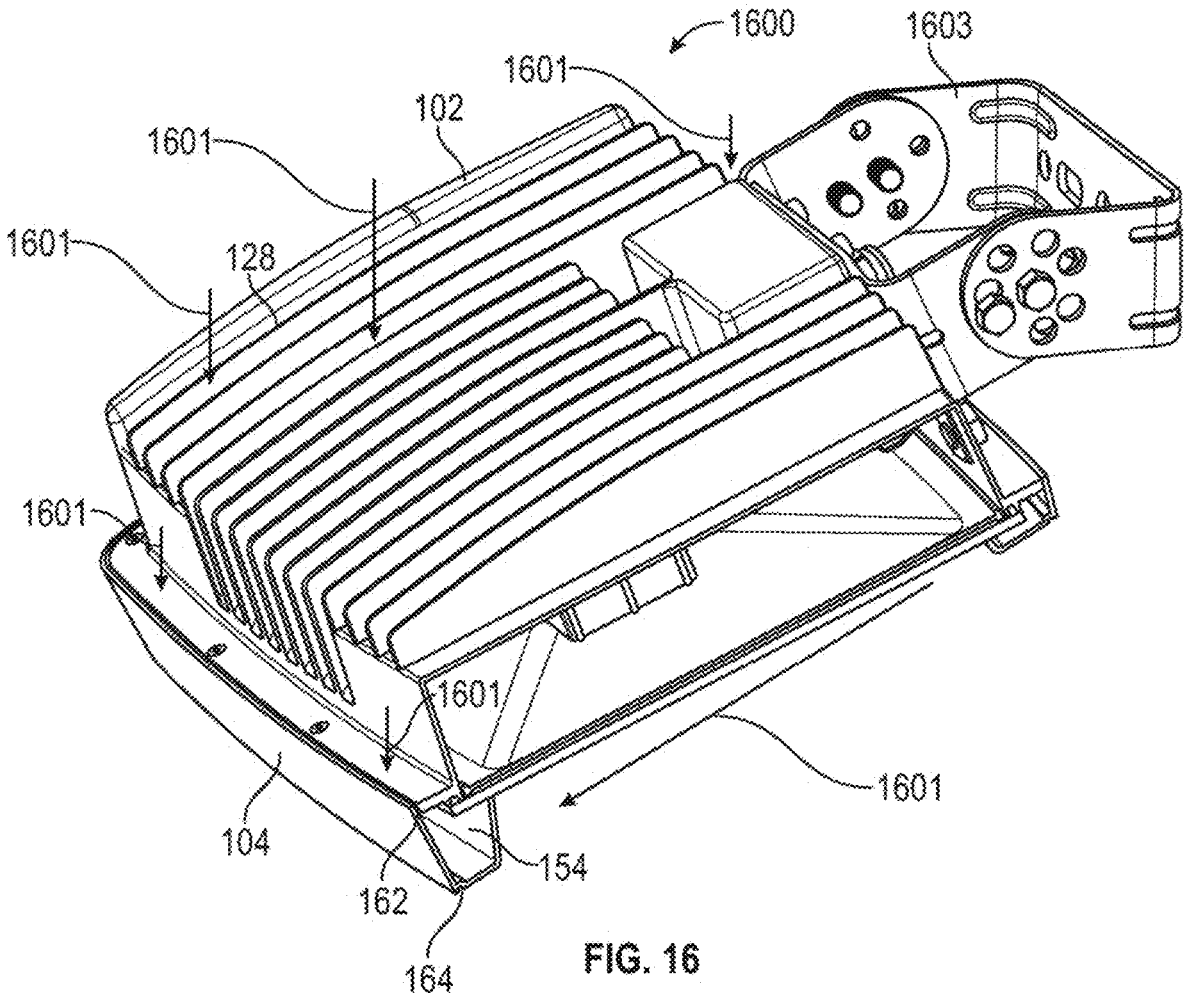
FIG. 16 is a perspective sectional view of a light fixture with a drainage system according to embodiments of the disclosure in a first installation configuration.

FIG. 16 illustrates the light fixture 1600 as an angled down-light installation. In this configuration, and as represented by arrows 1601, water falls on the rear of the light fixture 1600 and runs along the heat sink elements 128, which direct the water into the drainage gap 162. The water then runs through the drainage channel 154 and out the drainage openings 164 provided in the bezel 104. In this configuration, water may also run across the optic 106, into the weep openings 156, into the drainage channel 154, and out the drainage openings 164.

Figure 17:
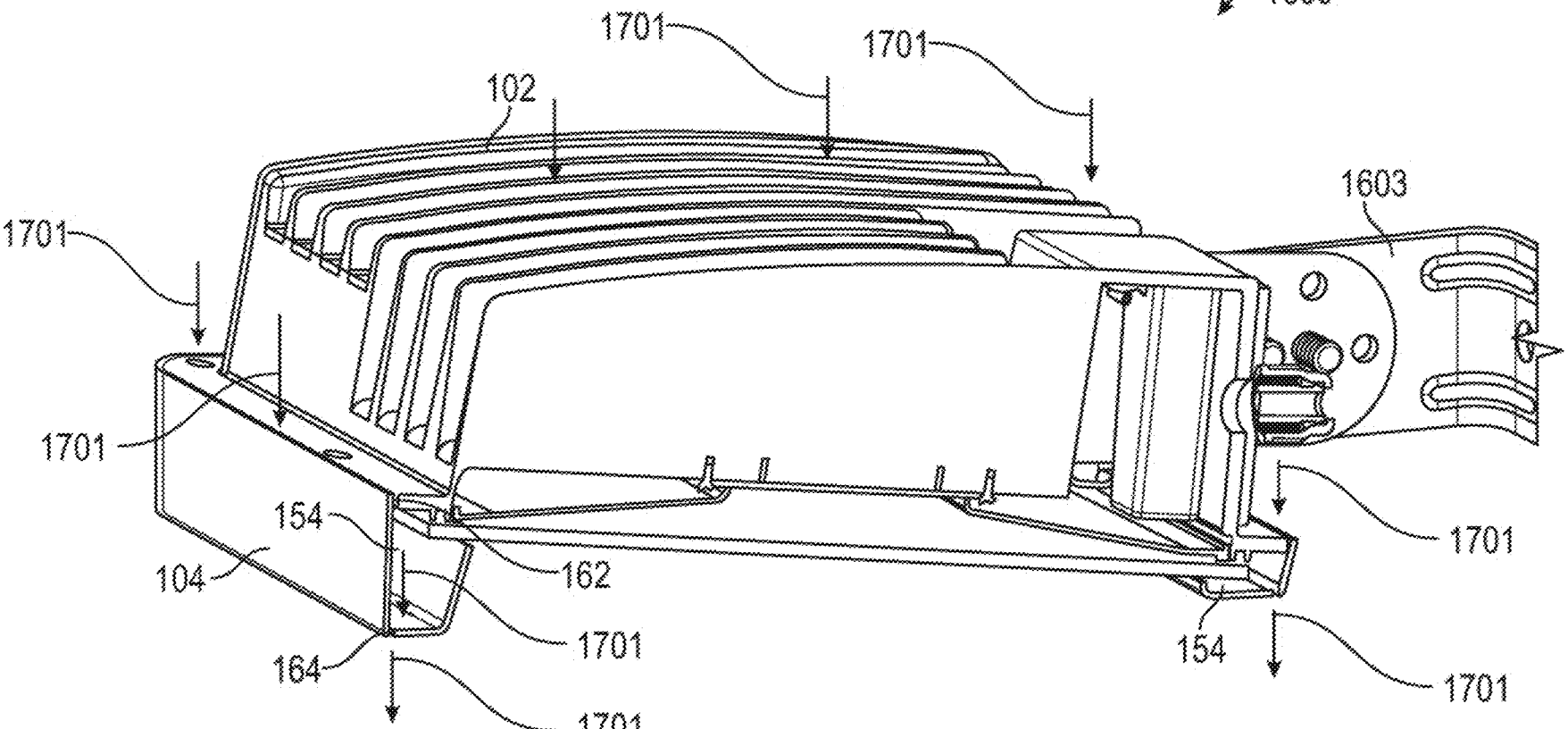
FIG. 17 is a perspective sectional view of the light fixture of FIG. 16 in a second installation configuration.

FIG. 17 illustrates the light fixture 1600 as a generally planar down-light installation. In this configuration, and as represented by arrows 1701, water falls on the rear of the light fixture 100 and runs into the drainage gap 162, through the drainage channel 154, and out the drainage openings 164.

Figure 18:
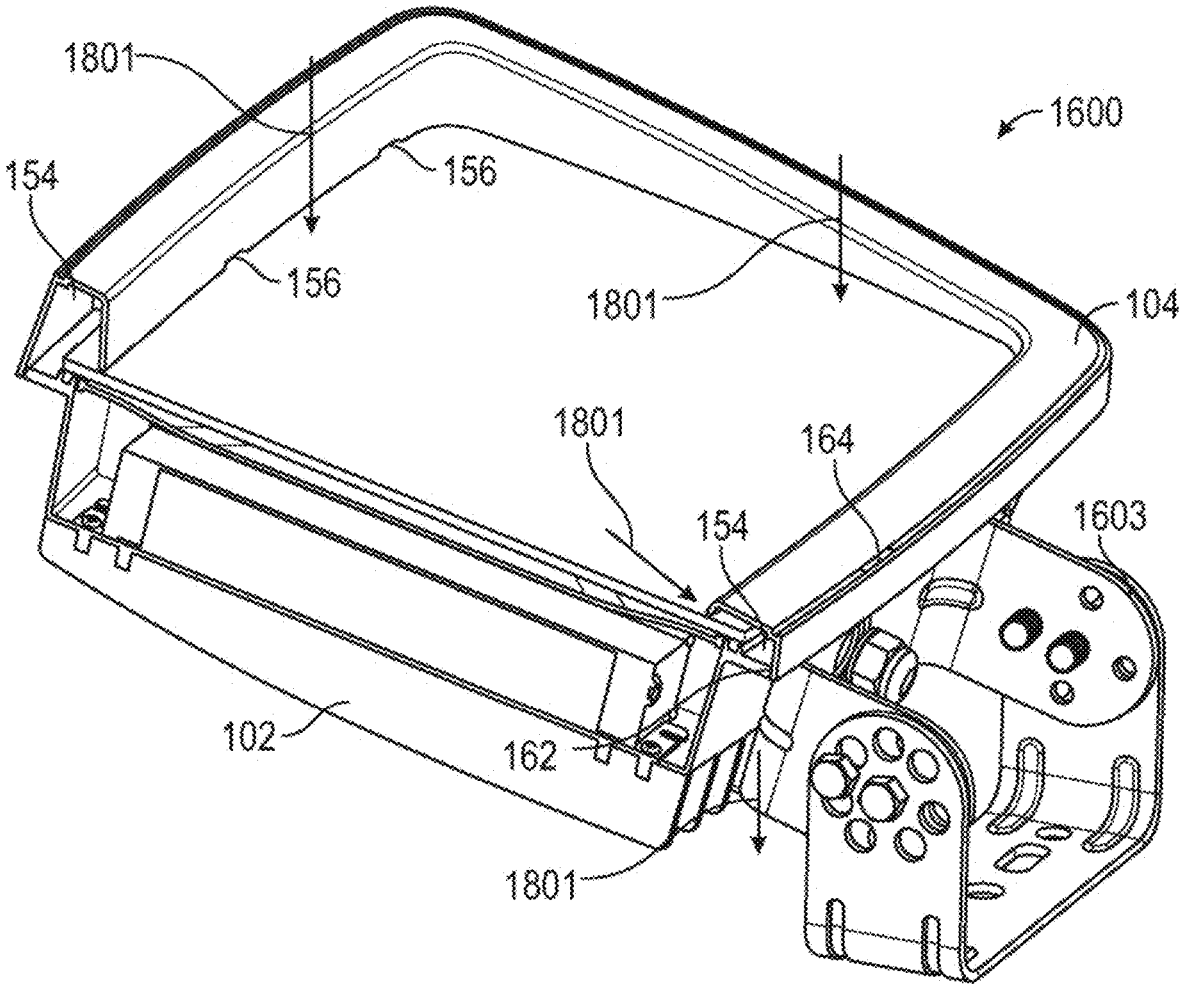
FIG. 18 is a perspective sectional view of the light fixture of FIG. 16 in a third installation configuration.
Figure 19:
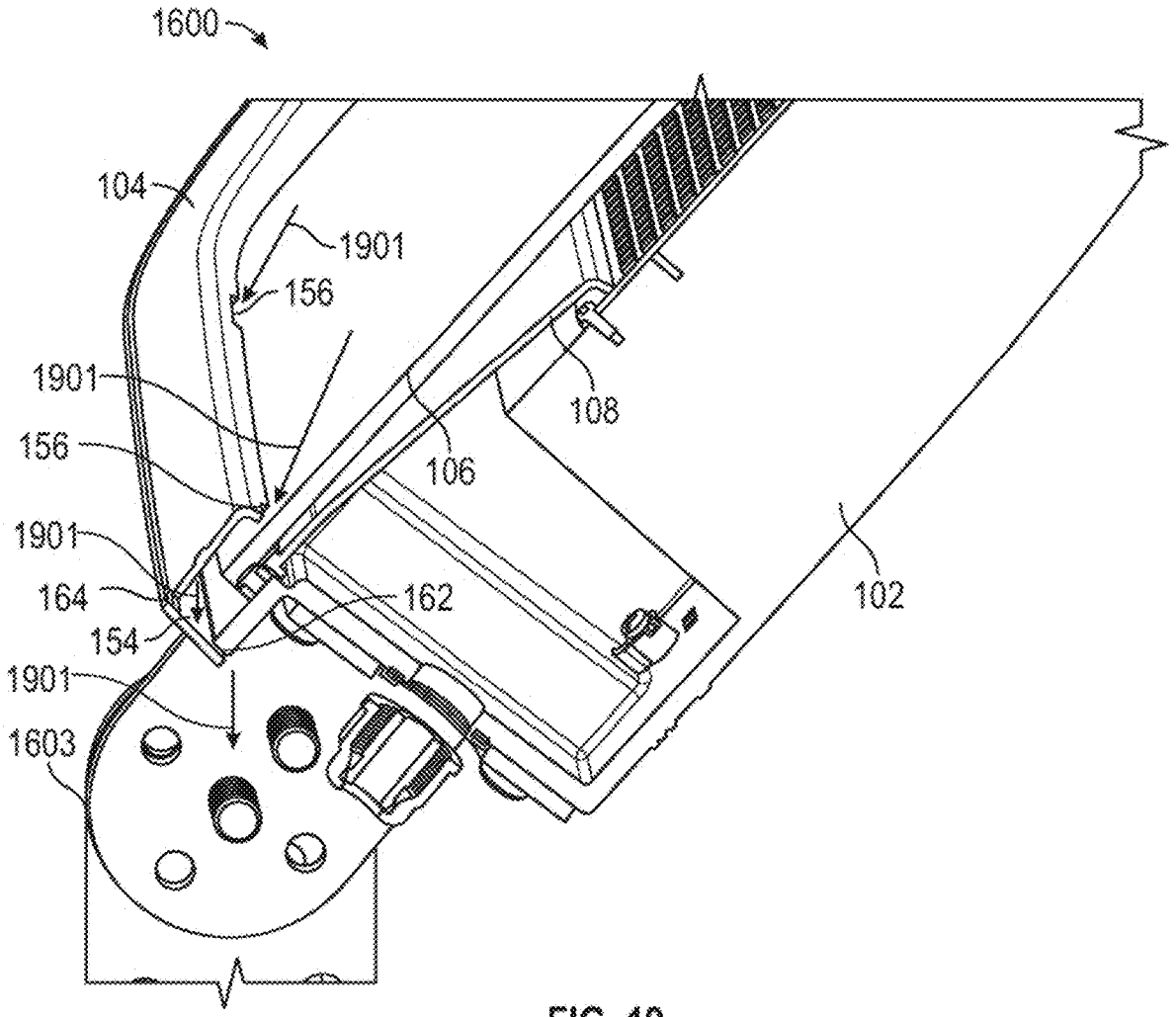
FIG. 19 is a perspective sectional view of the light fixture of FIG. 16 in a third installation configuration.

FIGS. 18 and 19 illustrate the light fixture 1600 as an up-light installation. In this configuration, and as represented by arrows 1801 in FIG. 18 and by arrows 1901 in FIG. 19, water falls on the front of the light fixture 100 (such as on the optic 106) and runs into the weep openings 156, into the drainage channel 154, and out the drainage gap 162.

One of skill in the art will appreciate that the drainage systems disclosed herein work to effectively dissipate water and other fluids from the light fixture 100 regardless of the orientation of the fixture.

EXAMPLES

A collection of exemplary embodiments, including at least some explicitly enumerated as "Examples" providing additional description of a variety of example types in accordance with the concepts described herein are provided below. These examples are not meant to be mutually exclusive, exhaustive, or restrictive; and the invention is not limited to these example examples but rather encompasses all possible modifications and variations within the scope of the issued claims and their equivalents.

Example 1. A bezel for a light fixture, the bezel comprising: an inner side wall defining a bezel opening that extends through the bezel from a front end of the bezel to a rear end of the bezel; an outer side wall; and a bezel face connecting the inner side wall and the outer side wall at the front end, wherein the inner side wall, the outer side wall, and the bezel face define a drainage channel, and wherein a portion of an edge of the inner side wall opposite from the bezel face comprises a drainage notch that is in fluid communication with the drainage channel.

Example 2. The bezel of any of the preceding or subsequent examples or combination of examples, wherein the bezel face comprises a drainage opening at the front end of the bezel and between the inner side wall and the outer side wall, and wherein the drainage opening is in fluid communication with the drainage channel.

Example 3. The bezel of any of the preceding or subsequent examples or combination of examples, wherein the bezel face comprises a groove defined in the bezel face and extending along at least a portion of the bezel opening, and wherein the drainage opening is in the groove.

Example 4. The bezel of any of the preceding or subsequent examples or combination of examples, wherein the drainage opening is a first drainage opening, wherein the bezel face comprises a plurality of drainage openings, and wherein the plurality of drainage openings are positioned at predetermined positions along a perimeter of the bezel face.

Example 5. The bezel of any of the preceding or subsequent examples or combination of examples, wherein a distance from the bezel face to the rear end of the bezel is greater than a distance from the bezel face to the edge of the inner side wall opposite from the bezel face.

Example 6. The bezel of any of the preceding or subsequent examples or combination of examples, wherein the outer side wall extends from the bezel face to the rear end of the bezel.

Example 7. The bezel of any of the preceding or subsequent examples or combination of examples, wherein the drainage notch is a first drainage notch, and wherein the edge of the inner side wall comprises a plurality of drainage notches.

Example 8. A light fixture comprising: a housing comprising a perimeter edge; and a bezel coupled to the housing, wherein the bezel comprises: an inner side wall defining a bezel opening that extends through the bezel from a front end of the bezel to a rear end of the bezel; an outer side wall; and a bezel face connecting the inner side wall and the outer side wall at the front end, wherein the inner side wall, the outer side wall, and the bezel face define a drainage channel, and wherein the bezel face comprises a drainage opening between the inner side wall and the outer side wall and that is in fluid communication with the drainage channel, and wherein the bezel is coupled to the housing such that a drainage gap is defined between an inner surface of the outer side wall and the perimeter edge of the housing that is in fluid communication with the drainage opening.

Example 9. The light fixture of any of the preceding or subsequent examples or combination of examples, further comprising an optic between an edge of the inner side wall opposite from the bezel face and the housing, and wherein at least a portion of edge of the inner side wall opposite from the bezel face abuts the optic.

Example 10. The light fixture of any of the preceding or subsequent examples or combination of examples, wherein the edge of the inner side wall opposite from the bezel face comprises a drainage notch, and wherein the edge of the inner side wall opposite from the bezel face abuts the optic such that a weep opening is defined between the inner side wall and the optic that is in fluid communication with the drainage channel.

Example 11. The light fixture of any of the preceding or subsequent examples or combination of examples, wherein the housing defines a housing chamber, wherein the light fixture further comprises a gasket between the optic and the housing and forming a fluid seal between the optic and the housing such that the housing chamber is sealed.

Example 12. The light fixture of any of the preceding or subsequent examples or combination of examples, wherein the bezel face comprises a groove defined in the bezel face and extending along at least a portion of the bezel opening, and wherein the drainage opening is in the groove.

Example 13. The light fixture of any of the preceding or subsequent examples or combination of examples, wherein the drainage opening is a first drainage opening, wherein the bezel face comprises a plurality of drainage openings, and wherein the plurality of drainage openings are positioned at predetermined positions along a perimeter of the bezel face.

Example 14. The light fixture of any of the preceding or subsequent examples or combination of examples, wherein the drainage opening is a first drainage opening, and wherein the bezel defines a plurality of drainage openings.

Example 15. A light fixture comprising: a housing; an optic; and a bezel, wherein the bezel is coupled to the housing such that the optic is positioned between at least a portion of the bezel and the housing, and wherein the bezel comprises a drainage system comprising: at least one drainage opening in the bezel proximate to a front side of the light fixture; at least one weep opening between the bezel and the optic; a drainage gap between the housing and the bezel proximate to a back side of the light fixture that is opposite the front side; and a drainage channel in fluid communication with the at least one drainage opening, the at least one weep opening, and the drainage gap.

Example 16. The light fixture of any of the preceding or subsequent examples or combination of examples, wherein: the optic comprises a front surface and a back surface; and the bezel comprises: an inner side wall defining a bezel opening that extends through the bezel from a front end of the bezel to a rear end of the bezel; an outer side wall; and a bezel face connecting the inner side wall and the outer side wall at the front end, wherein a portion of an edge of the inner side wall opposite from the bezel face comprises a drainage notch, wherein the inner side wall, the outer side wall, and the bezel face define the drainage channel, and wherein the edge of the inner side wall abuts the optic such that the drainage notch defines the at least one weep opening.

Example 17. The light fixture of any of the preceding or subsequent examples or combination of examples, further comprising a gasket between the optic and the housing.

Example 18. The light fixture of any of the preceding or subsequent examples or combination of examples, wherein the housing comprises a perimeter edge, wherein the bezel further comprises: an inner side wall defining a bezel opening that extends through the bezel from a front end of the bezel to a rear end of the bezel; an outer side wall; and a bezel face connecting the inner side wall and the outer side wall at the front end, wherein the inner side wall, the outer side wall, and the bezel face define the drainage channel, and wherein the drainage gap is defined between an inner surface of the outer side wall and the perimeter edge of the housing.

Example 19. The light fixture of any of the preceding or subsequent examples or combination of examples, wherein the bezel further comprises: an inner side wall defining a bezel opening that extends through the bezel from a front end of the bezel to a rear end of the bezel; an outer side wall; and a bezel face connecting the inner side wall and the outer side wall at the front end, wherein the inner side wall, the outer side wall, and the bezel face define the drainage channel, and wherein the bezel face defines the at least one drainage opening between the inner side wall and the outer side wall.

Example 20. The light fixture of any of the preceding or subsequent examples or combination of examples, wherein the bezel face comprises a groove, and wherein the at least one drainage opening is in the groove.

Different arrangements of the components depicted in the drawings or described above, as well as components and steps not shown or described are possible. Similarly, some features and sub-combinations are useful and may be employed without reference to other features and sub-combinations. Examples of the invention have been described for illustrative and not restrictive purposes, and alternative examples will become apparent to readers of this patent. Accordingly, the present invention is not limited to the examples described above or depicted in the drawings, and various examples and modifications may be made without departing from the scope of the claims below.

That which is claimed:

1. A bezel for a light fixture, the bezel comprising:

an inner side wall defining a bezel opening that extends through the bezel from a front end of the bezel to a rear end of the bezel;

an outer side wall; and a bezel face connecting the inner side wall and the outer side wall at the front end, wherein the inner side wall, the outer side wall, and the bezel face define a drainage channel, and wherein a portion of an edge of the inner side wall opposite from the bezel face comprises a drainage notch that is in fluid communication with the drainage channel.

2. The bezel of claim 1, wherein the bezel face comprises a drainage opening at the front end of the bezel and between the inner side wall and the outer side wall, and wherein the drainage opening is in fluid communication with the drainage channel.

3. The bezel of claim 2, wherein the bezel face comprises a groove defined in the bezel face and extending along at least a portion of the bezel opening, and wherein the drainage opening is in the groove.

4. The bezel of claim 2, wherein the drainage opening is a first drainage opening, wherein the bezel face comprises a plurality of drainage openings, and wherein the plurality of drainage openings are positioned at predetermined positions along a perimeter of the bezel face.

5. The bezel of claim 1, wherein a distance from the bezel face to the rear end of the bezel is greater than a distance from the bezel face to the edge of the inner side wall opposite from the bezel face.

6. The bezel of claim 5, wherein the outer side wall extends from the bezel face to the rear end of the bezel.

7. The bezel of claim 1, wherein the drainage notch is a first drainage notch, and wherein the edge of the inner side wall comprises a plurality of drainage notches.

8. A light fixture comprising:

a housing comprising a perimeter edge; and a bezel coupled to the housing, wherein the bezel comprises:

an inner side wall defining a bezel opening that extends through the bezel from a front end of the bezel to a rear end of the bezel;

an outer side wall; and a bezel face connecting the inner side wall and the outer side wall at the front end, wherein the inner side wall, the outer side wall, and the bezel face define a drainage channel, wherein the bezel face comprises a drainage opening between the inner side wall and the outer side wall and that is in fluid communication with the drainage channel, and wherein the bezel is coupled to the housing such that a drainage gap is defined between an inner surface of the outer side wall and the perimeter edge of the housing that is in fluid communication with the drainage opening.

9. The light fixture of claim 8, further comprising an optic between an edge of the inner side wall opposite from the bezel face and the housing, and wherein at least a portion of edge of the inner side wall opposite from the bezel face abuts the optic.

10. The light fixture of claim 9, wherein the edge of the inner side wall opposite from the bezel face comprises a drainage notch, and wherein the edge of the inner side wall opposite from the bezel face abuts the optic such that a weep opening is defined between the inner side wall and the optic that is in fluid communication with the drainage channel.

11. The light fixture of claim 9, wherein the housing defines a housing chamber, wherein the light fixture further comprises a gasket between the optic and the housing and forming a fluid seal between the optic and the housing such that the housing chamber is sealed.

12. The light fixture of claim 8, wherein the bezel face comprises a groove defined in the bezel face and extending along at least a portion of the bezel opening, and wherein the drainage opening is in the groove.

13. The light fixture of claim 8, wherein the drainage opening is a first drainage opening, wherein the bezel face comprises a plurality of drainage openings, and wherein the plurality of drainage openings are positioned at predetermined positions along a perimeter of the bezel face.

14. The light fixture of claim 8, wherein the drainage opening is a first drainage opening, and wherein the bezel defines a plurality of drainage openings.

15. A light fixture comprising:

a housing;

an optic; and a bezel, wherein the bezel is coupled to the housing such that the optic is positioned between at least a portion of the bezel and the housing in a front-to-back direction extending between a front side of the light fixture and a back side of the light fixture, and wherein the bezel comprises a drainage system comprising:

at least one drainage opening in the bezel proximate to the front side of the light fixture;

at least one weep opening between the bezel and the optic;

a drainage gap between the housing and the bezel proximate to the back side of the light fixture that is opposite the front side; and a drainage channel in fluid communication with the at least one drainage opening, the at least one weep opening, and the drainage gap.

16. The light fixture of claim 15, wherein:

the optic comprises a front surface and a back surface; and the bezel comprises:

an inner side wall defining a bezel opening that extends through the bezel from a front end of the bezel to a rear end of the bezel;

an outer side wall; and a bezel face connecting the inner side wall and the outer side wall at the front end, wherein a portion of an edge of the inner side wall opposite from the bezel face comprises a drainage notch, wherein the inner side wall, the outer side wall, and the bezel face define the drainage channel, and wherein the edge of the inner side wall abuts the optic such that the drainage notch defines the at least one weep opening.

17. The light fixture of claim 15, further comprising a gasket between the optic and the housing.

18. The light fixture of claim 15, wherein the housing comprises a perimeter edge, wherein the bezel further comprises:

an inner side wall defining a bezel opening that extends through the bezel from a front end of the bezel to a rear end of the bezel;

an outer side wall; and a bezel face connecting the inner side wall and the outer side wall at the front end, wherein the inner side wall, the outer side wall, and the bezel face define the drainage channel, and wherein the drainage gap is defined between an inner surface of the outer side wall and the perimeter edge of the housing.

19. The light fixture of claim 15, wherein the bezel further comprises:

an inner side wall defining a bezel opening that extends through the bezel from a front end of the bezel to a rear end of the bezel;

an outer side wall; and a bezel face connecting the inner side wall and the outer side wall at the front end, wherein the inner side wall, the outer side wall, and the bezel face define the drainage channel, and wherein the bezel face defines the at least one drainage opening between the inner side wall and the outer side wall.

20. The light fixture of claim 19, wherein the bezel face comprises a groove, and wherein the at least one drainage opening is in the groove.

* * * * *